US006676580B2

(12) United States Patent
Tsai et al.

(10) Patent No.: US 6,676,580 B2
(45) Date of Patent: Jan. 13, 2004

(54) EXERCISE DEVICE

(76) Inventors: Cheng-Chung Tsai, No. 123, Ho-Ping Rd., Liu-Pao Village, Ta-Ya Hsiang, Taichung Hsien (TW); Cheng-Li Tsai, No. 350, Sec. 4, Chung-Ching Rd. Liu-Pao Village, Ta-Ya Hsiang, Taichung Hsien (TW)

( * ) Notice: Subject to any disclaimer, the term of this patent is extended or adjusted under 35 U.S.C. 154(b) by 391 days.

(21) Appl. No.: 09/847,105

(22) Filed: May 3, 2001

(65) Prior Publication Data

US 2002/0165073 A1 Nov. 7, 2002

(51) Int. Cl.[7] ..... A61H 1/00

(52) U.S. Cl. ..... 482/148; 482/132; 601/19; 601/125

(58) Field of Search ..... 482/148, 51, 121, 482/130, 126, 132; 601/1, 19, 80, 94, 99, 118, 119, 120, 123, 125

(56) References Cited

U.S. PATENT DOCUMENTS

| | | | | |
|---|---|---|---|---|
| 2,219,138 A | * | 10/1940 | Morrison | 601/125 |
| 2,533,528 A | * | 12/1950 | Somersal | 72/341 |
| 3,957,039 A | * | 5/1976 | Ehren | 601/132 |
| 5,848,980 A | * | 12/1998 | Demerais | 601/46 |
| 6,241,693 B1 | * | 6/2001 | Lambden | 601/15 |

* cited by examiner

*Primary Examiner*—Stephen R. Crow
(74) *Attorney, Agent, or Firm*—Harrison & Egbert

(57) ABSTRACT

A portable exercise device includes a U-shaped frame having two free ends opposite in location to each other. The two free ends are provided with a plurality of orientation rollers pivoted thereto, and a swivel arm pivoted thereto. The swivel arms of the two free ends are connected by an elastic belt and are provided with a plurality of pressure rollers pivoted thereto. As the U-shaped frame is moved in all directions by an exerciser, the orientation rollers and the pressure rollers roll over the waist and the belly of the exerciser.

4 Claims, 8 Drawing Sheets

EXERCISE DEVICE

BACKGROUND OF THE INVENTION

1. Field of the Invention

The present invention relates generally to an exercise device, and more particularly to an exercise device which is designed to work out the waist, the belly, and the hips of a human body.

2. Description of Related Art

The conventional exercise device is generally cumbersome and is often confined in a gymnasium. As people are increasingly occupied with business activities, they have little time to go to the gymnasium to do the workout for the sake of physical fitness.

BRIEF SUMMARY OF THE INVENTION

It is the primary objective of the present invention is to provide an exercise device which is so portable that it can be used at home or in the office.

It is another objective of the present invention to provide an exercise device which is designed to work out specific parts of a human body.

In keeping with the principle of the present invention, the foregoing objectives of the present invention are attained by the exercise device comprising a U-shaped frame having two free ends opposite to each other. The two free ends are provided with a plurality of orientation rollers and a swivel arm which is in turn provided with a plurality of pressure rollers. The two swivel arms are connected by an elastic belt. As the frame is moved in all directions, the orientation rollers and the pressure rollers roll over the waist, the belly, and the hips of the body of an exerciser.

The features and functions of the present invention will be more readily understood upon a thoughtful deliberation of the following detailed description of the present invention with reference to the accompanying drawings.

DETAILED DESCRIPTION OF THE INVENTION

Figure 1:
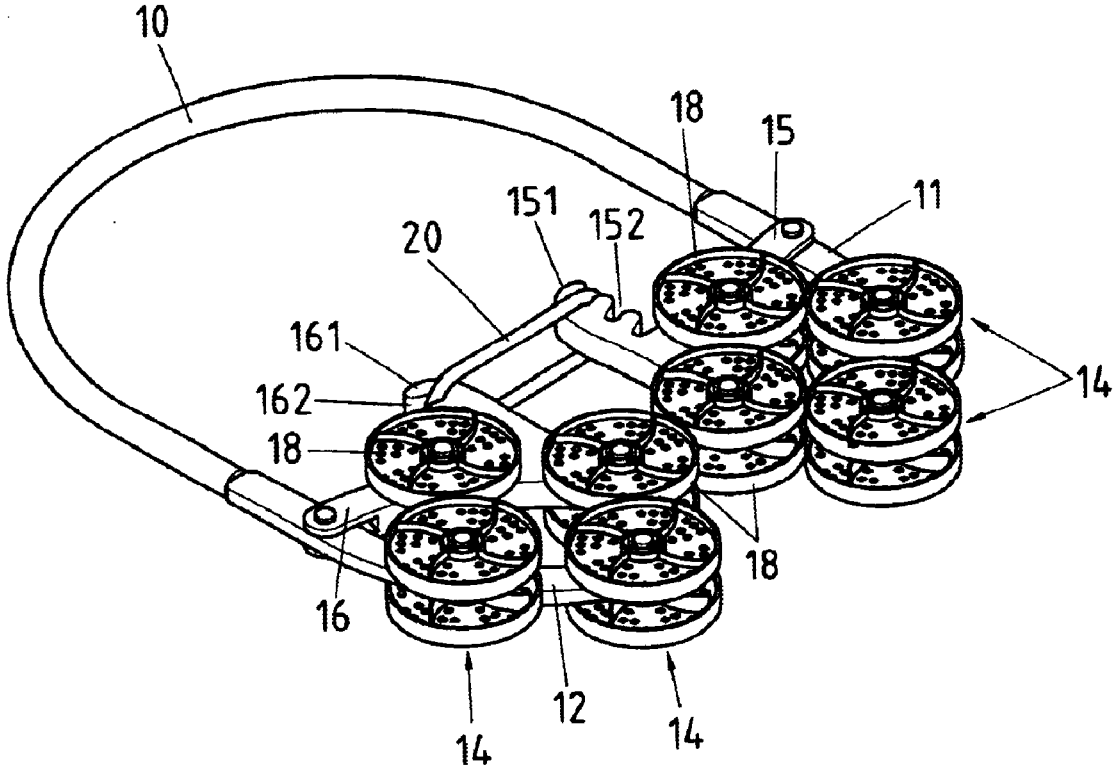
FIG. 1 shows a perspective view of the present invention.
Figure 2:
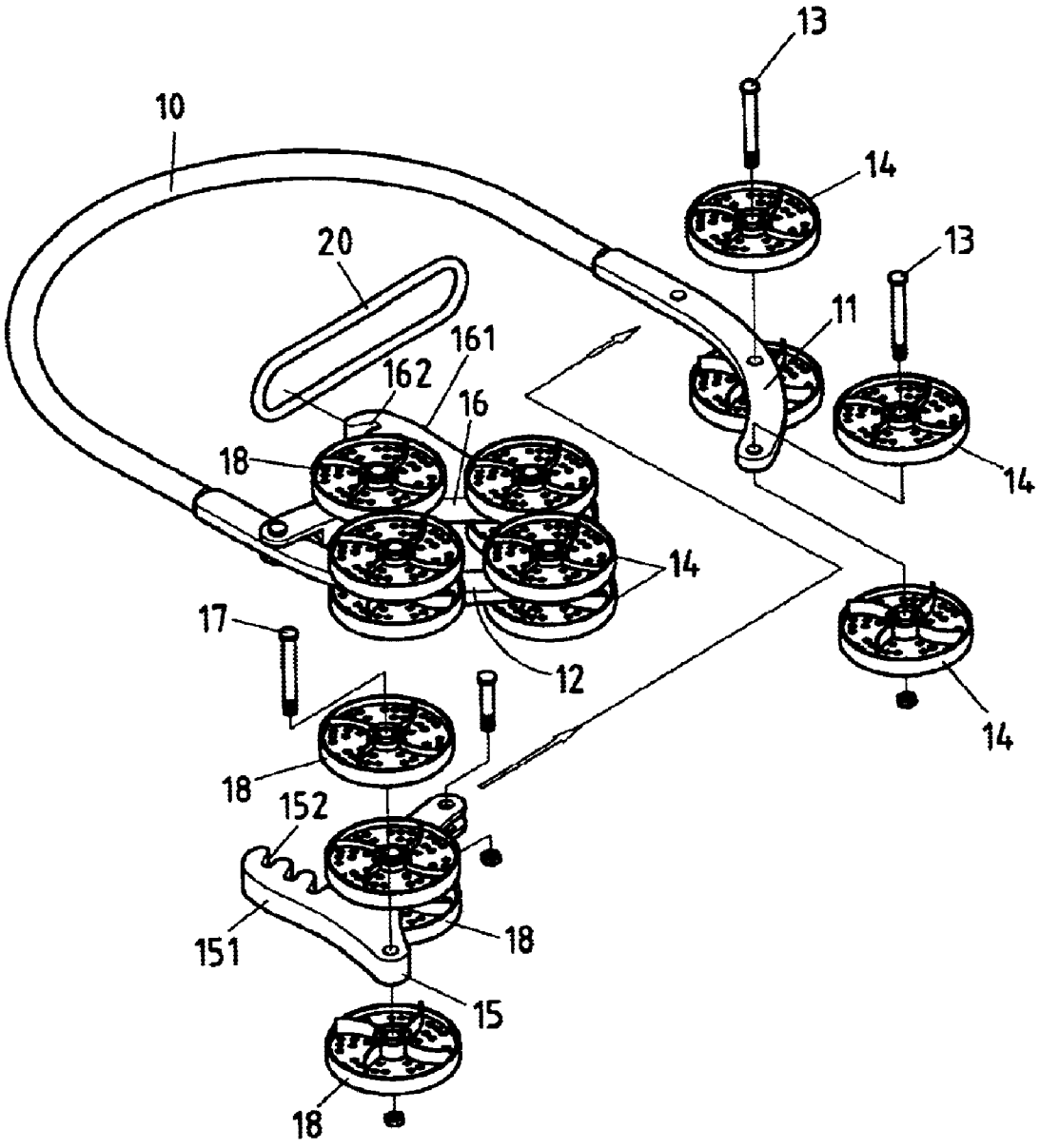
FIG. 2 shows an exploded view of the present invention.
Figure 3:
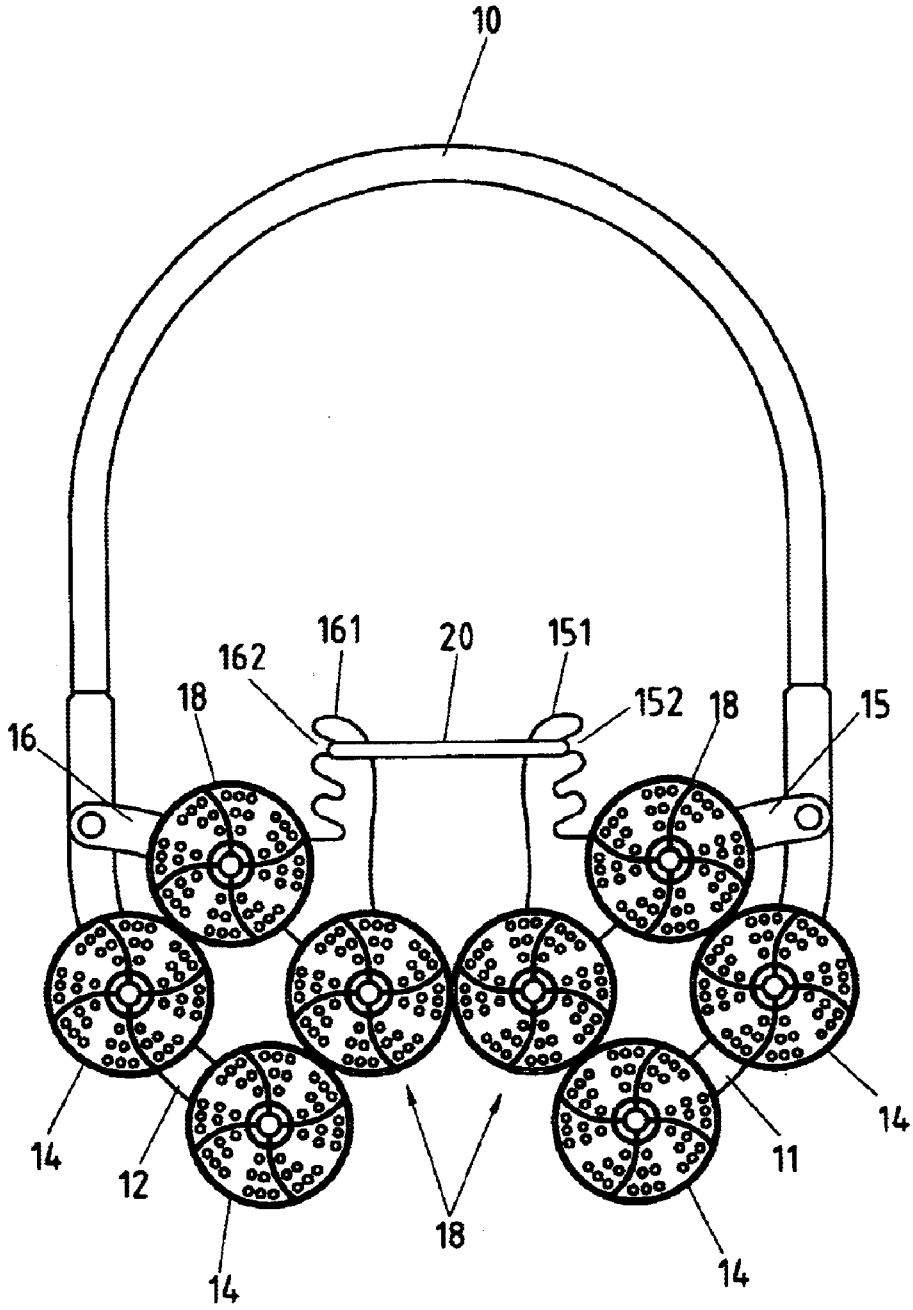
FIG. 3 shows a schematic plan view of the present invention.
Figure 4:
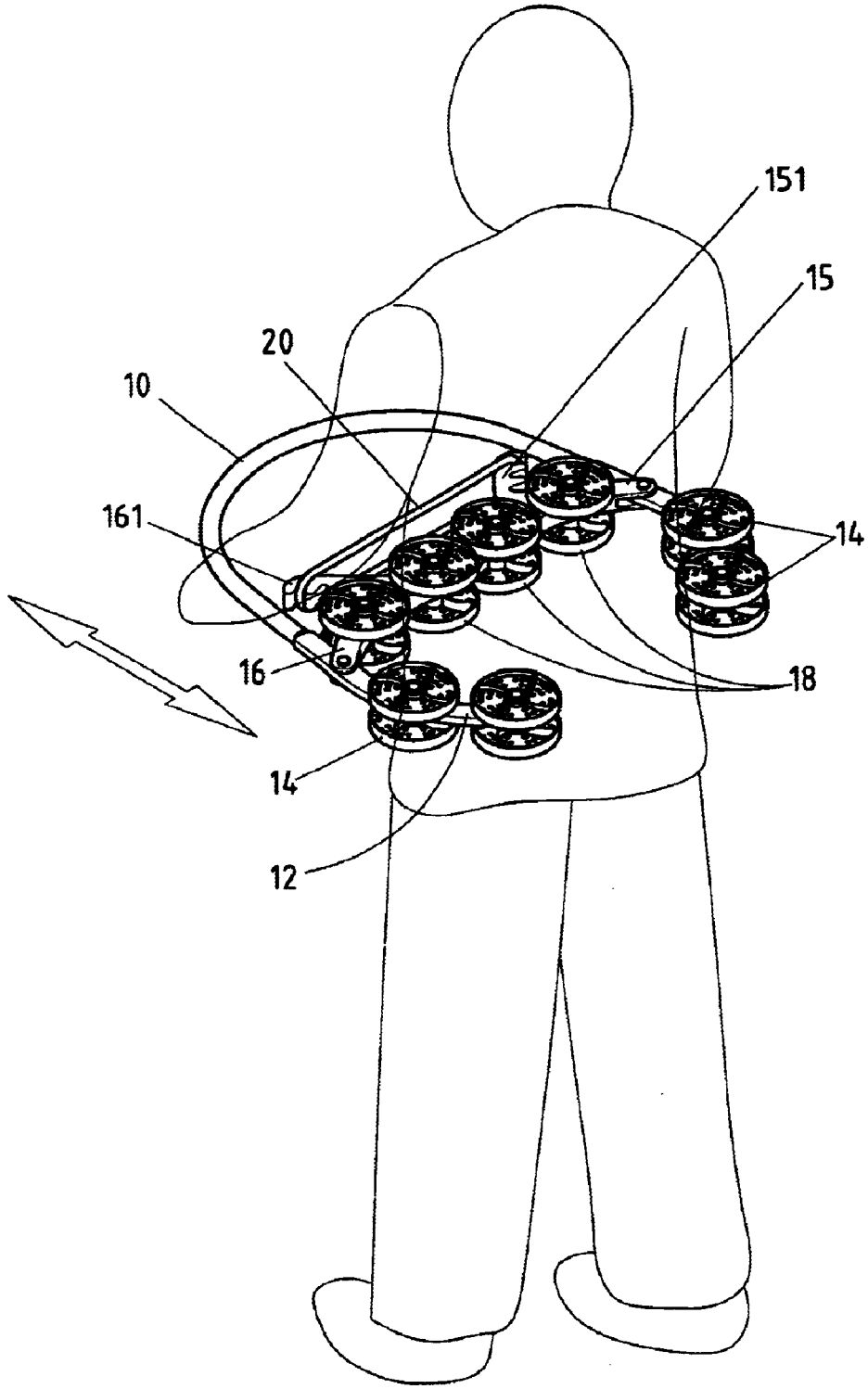
FIG. 4 shows a schematic view of the present invention at work.
Figure 6:
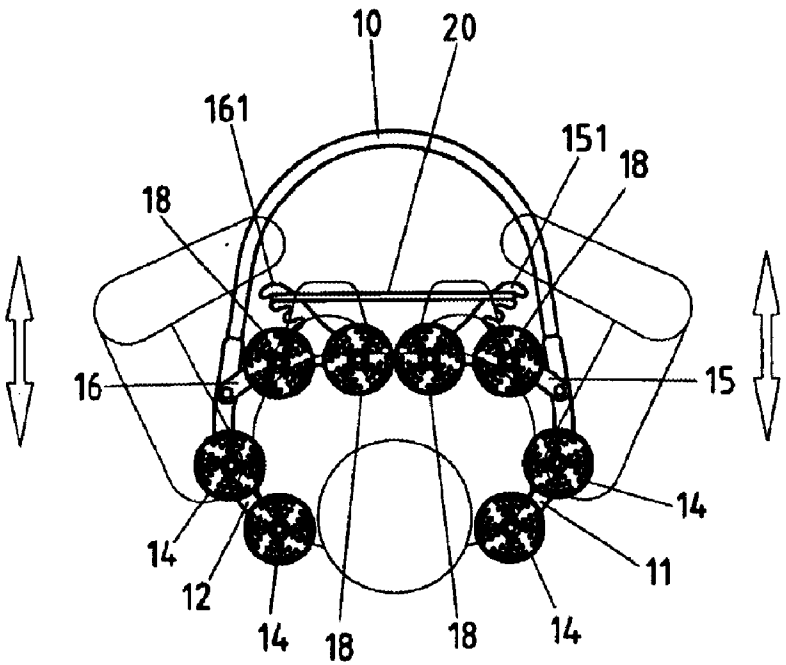
FIG. 6 shows another top plan view of the present invention at work.
Figure 5:
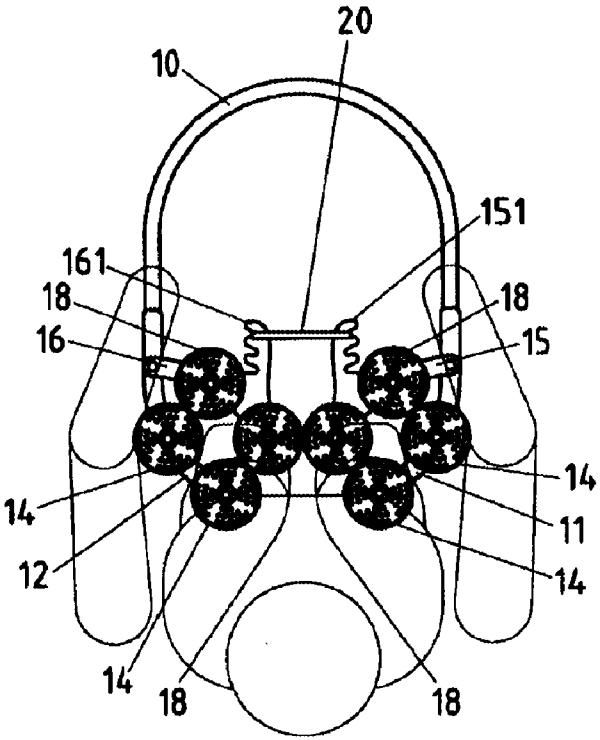
FIG. 5 shows a top plan view of the present invention at work.
Figure 8:
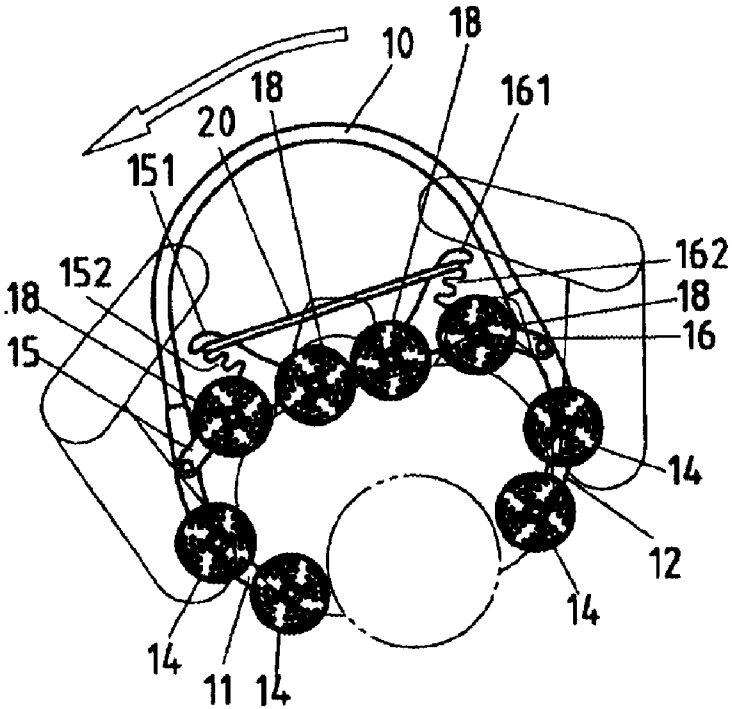
FIG. 8 shows still another top plan view of the present invention at work.
Figure 7:
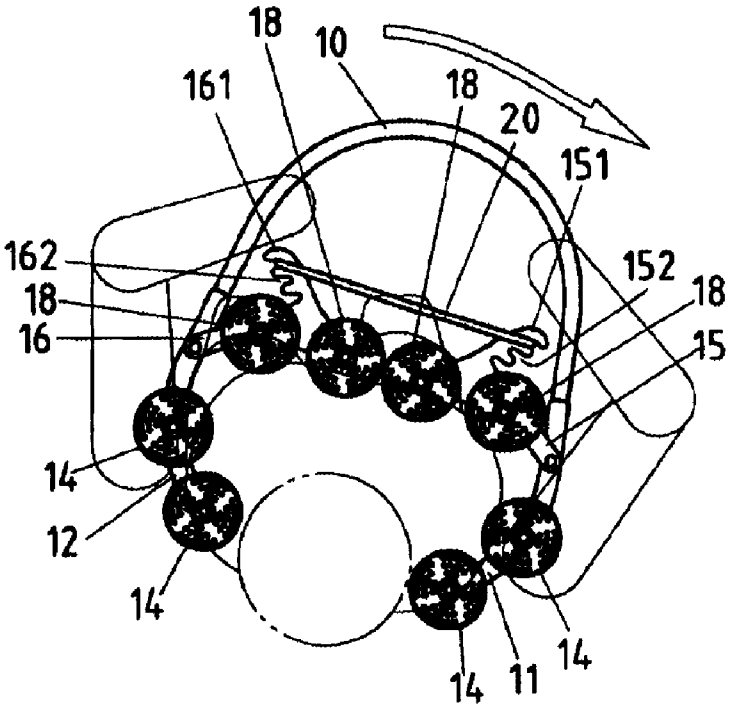
FIG. 7 shows still another top plan view of the present invention at work.
Figure 9:
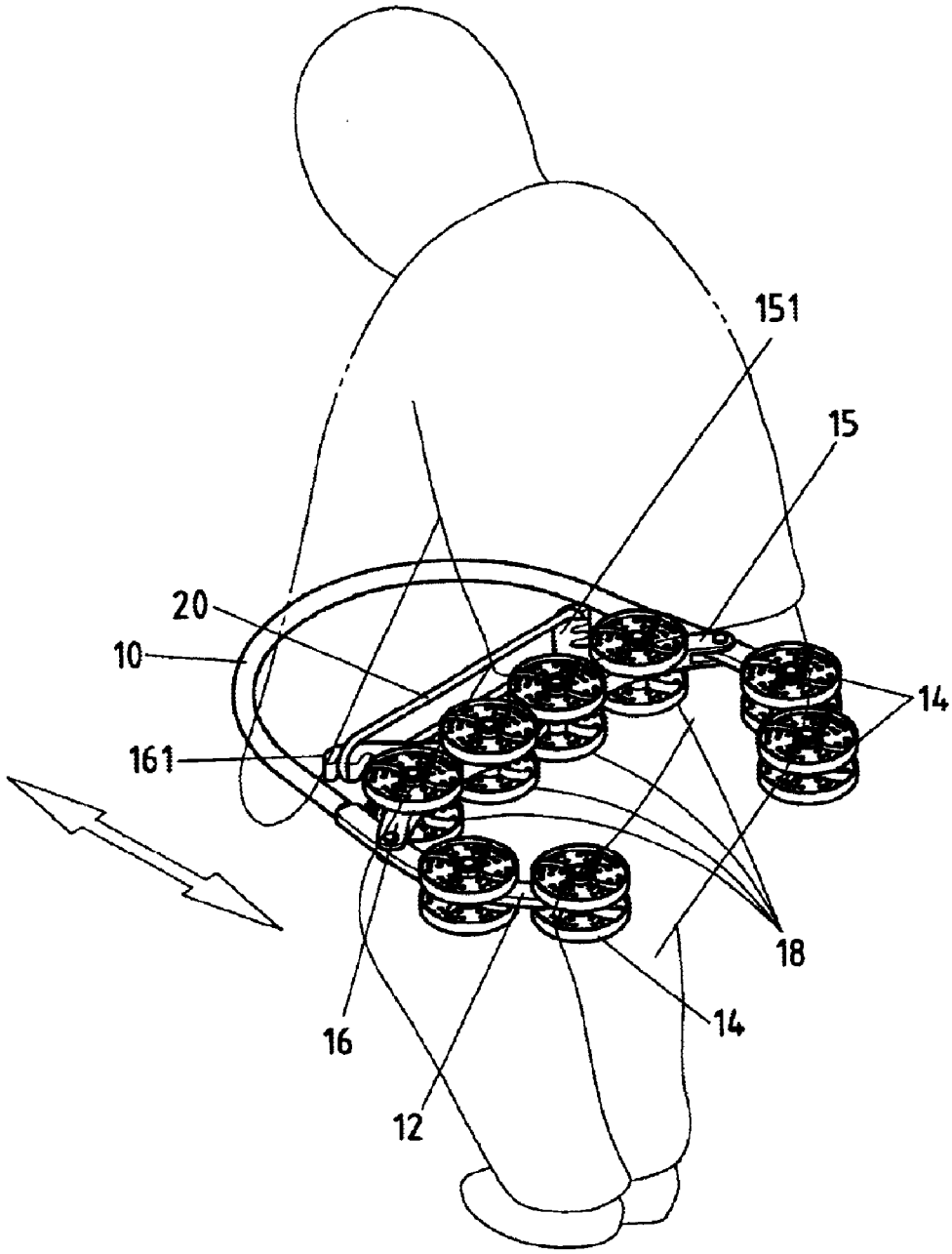
FIG. 9 shows a schematic view of the present invention in use.

As shown in FIGS. 1–3, an exercise device embodied in the present invention comprises a U-shaped frame 10 having two free ends 11 and 12, which are opposite to each other and are curved in the direction toward each other. The two free ends 11 and 12 are provided with a plurality of orientation rollers 14 fastened pivotally thereto by a plurality of bolts 13, and are further provided with a swivel arm 15, 16. The swivel arms 15 and 16 are provided with a plurality of pressure rollers 18 fastened pivotally thereto by a plurality of bolts 17. The two swivel arms 15 and 16 are connected by an elastic belt 20.

In operation, the orientation rollers 14 and the pressure rollers 18 roll over the waist, the hips, and the belly of an exerciser, as the frame 10 is moved with both hands of the exerciser in forward, backward, leftward, and rightward directions, as illustrated in FIGS. 4–9.

The swivel arms 15 and 16 are respectively provided with a protruded block 151, 161. The protruded block 151, 161 is provided with a plurality of retaining slots 152, 162. The retaining slots 152 and 162 are intended to retain the elastic belt 20 which is an endless belt connecting the two swivel arms 15 and 16.

The two swivel arms 15 and 16 are respectively curved in the direction toward the free ends 11 and 12.

The frame 10 of the exercise device of the present invention is made of a material having elasticity.

As the center of the U-shaped frame 10 is moved backward toward the belly of an exerciser, the orientation rollers 14 roll from the belly toward the sides of the waist. In the meantime, the free ends 11 and 12 move away from each other to widen the distance therebetween. As the frame 10 is progressively moved backward, the belly of the exerciser comes in contact with the pressure rollers 18 of the two swivel arms 15 and 16. The two swivel arms 15 and 16 are linked to swivel toward the outer sides of the belly, thereby resulting in an increase in distance between the protruded blocks 151 and 161 of the two swivel arms 15 and 16. As a result, the elastic belt 20 is expanded. When the orientation rollers 14 roll to the back side of the waist, the elastic forces of the frame 10 and the elastic belt 20 enable the orientation rollers 14 and the pressure rollers 18 to press against the back side of the waist as well as the belly.

The exercise device of the present invention can be miniaturized to bring about the workout of arms, legs, and the like.

Figure 10:
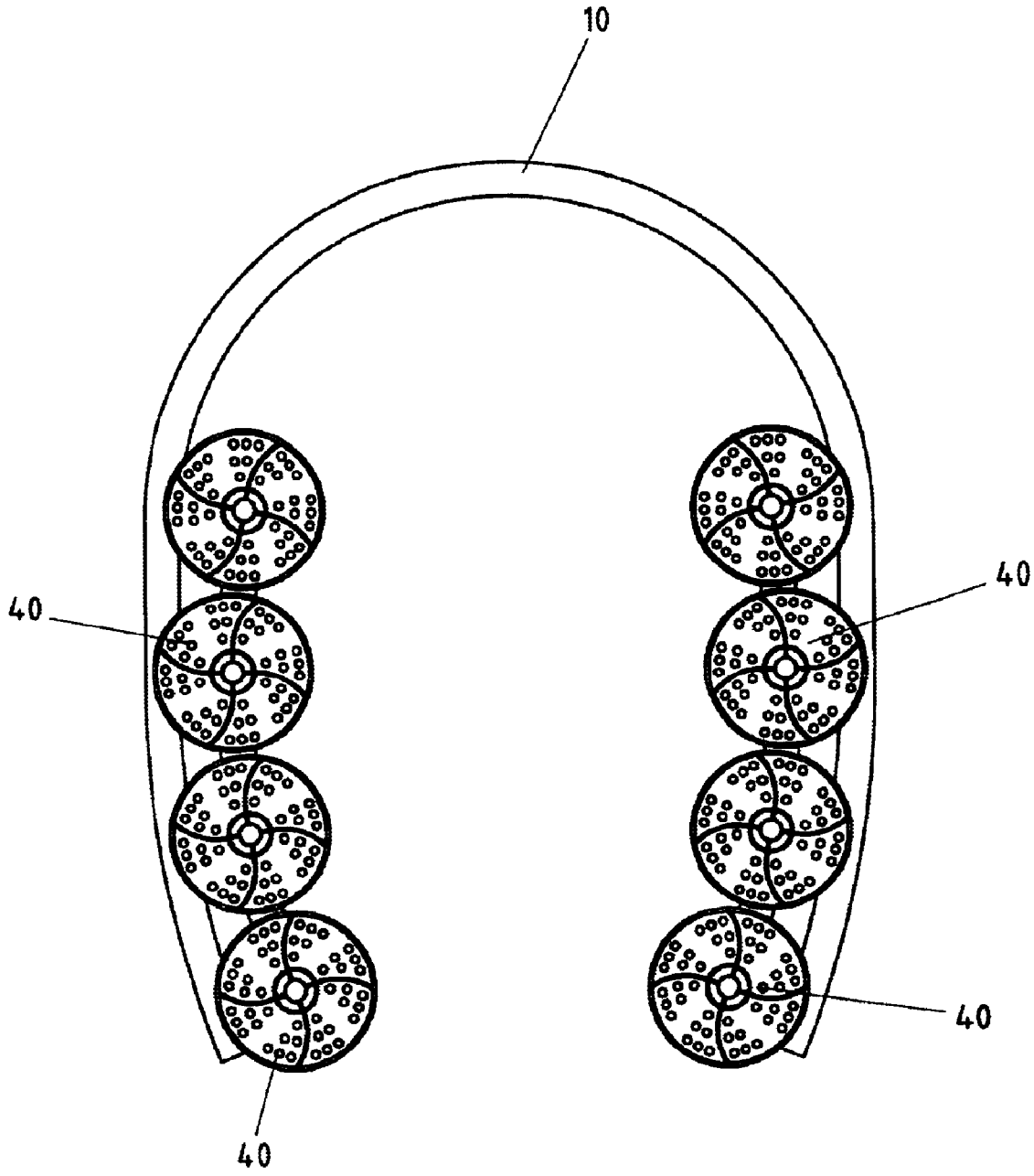
FIG. 10 shows a schematic plan view of another preferred embodiment of the present invention.

Now referring to FIG. 10, an exercise device of another preferred embodiment of the present invention comprises a U-shaped frame 10 and a plurality of rollers 40 which are pivoted to the inner sides of two opposite arms of the frame 10. The exercise device is designed to work out the waist in such a manner that the rollers 40 of the two arms of the frame 10 roll over two sides of the waist.

The embodiments of the present invention described above are to be regarded in all respects as being merely illustrative and not restrictive. Accordingly, the present invention may be embodied in other specific forms without deviating from the spirit thereof. The present invention is therefore to be limited only by the scope of the following claims.

We claim:

1. An exercise device comprising a U-shaped frame having two free ends opposite to each other, said two free ends being curved in a direction toward each other and being provided with a plurality of orientation rollers fastened pivotally thereto, said two free ends further provided with a swivel arm pivoted thereto, said swivel arm provided with a plurality of pressure rollers, said two swivel arms of said two free ends being connected with an elastic belt whereby said orientation rollers and said pressure rollers roll over the waist and the belly of an exerciser at such time when said U-shaped frame is moved with both hands of the exerciser in forward, backward, leftward, and rightward directions in relation to the body of the exerciser.

2. The exercise device as defined in claim 1, wherein said swivel arms of said two free ends of said frame further comprise a protruded block whereby said protruded block is provided with a plurality of retaining slots; wherein said elastic belt is retained in said retaining slots of said protruded blocks of said two swivel arms of said two free ends.

3. The exercise device as defined in claim 1, wherein said two swivel arms are curved in the direction toward said free ends.

4. The exercise device as defined in claim 1, wherein said U-shaped frame is comprised of a material having an elasticity.

* * * * *